US009185945B2

(12) United States Patent
Rietdyk

(10) Patent No.: US 9,185,945 B2
(45) Date of Patent: Nov. 17, 2015

(54) NECK COLLAR

(75) Inventor: Guido Rietdyk, Rancho Dominguez, CA (US)

(73) Assignee: EVS Sports, Rancho Dominguez, CA (US)

( * ) Notice: Subject to any disclaimer, the term of this patent is extended or adjusted under 35 U.S.C. 154(b) by 0 days.

(21) Appl. No.: 13/277,019

(22) Filed: Oct. 19, 2011

(65) Prior Publication Data

US 2013/0102941 A1 Apr. 25, 2013

(51) Int. Cl.

| | |
|---|---|
| ***A61F 5/00*** | (2006.01) |
| ***A42B 3/04*** | (2006.01) |
| *A41D 13/05* | (2006.01) |

(52) U.S. Cl.

CPC ..... *A42B 3/0473* (2013.01); *A41D 13/0512* (2013.01)

(58) Field of Classification Search

CPC .. A41D 13/0512; A42B 3/0473; A61F 5/055; A61F 5/05883

USPC ..... 602/18, 19, 5, 6; 2/468, 461, 459, 467

See application file for complete search history.

(56) References Cited

U.S. PATENT DOCUMENTS

| | | | | |
|---|---|---|---|---|
| 3,189,917 | A | 6/1965 | Sims | |
| 4,700,697 | A * | 10/1987 | Mundell et al. | 602/18 |
| 8,142,380 | B2 * | 3/2012 | Hasegawa | 602/18 |
| 8,162,865 | B2 * | 4/2012 | Mazzarolo | 602/18 |
| 2010/0056968 | A1 | 3/2010 | Mazzarolo | |
| 2010/0088808 | A1 | 4/2010 | Rietdyk et al. | |
| 2010/0263112 | A1 * | 10/2010 | Mazzarolo et al. | 2/468 |
| 2011/0225713 | A1 | 9/2011 | Lopez Vicente et al. | |
| 2012/0192340 | A1 * | 8/2012 | Minson | 2/468 |
| 2012/0209160 | A1 * | 8/2012 | Thorgilsdottir et al. | 602/18 |

FOREIGN PATENT DOCUMENTS

| | | |
|---|---|---|
| EP | 2113231 | 11/2009 |

* cited by examiner

*Primary Examiner* — Victoria J Hicks

(74) *Attorney, Agent, or Firm* — Darren J. Jones; Lowe Graham Jones, PLLC

(57) ABSTRACT

A neck collar interfacing with a lower edge of a helmet of a wearer. The collar includes a pad and a shell. The pad is formed of a closed-cell foam material and forms a loop to be secured about the neck of the wearer. A plurality of shell components are secured to portions of the upper face of the pad. The shell is more rigid than the pad to spread the energy of impact with a lower edge of the helmet over a larger region of the pad. The shell and pad each include a chest portion having a split for opening the pad for putting the collar on and taking it off. The shell components are discontinuous at at least one lateral portion of the pad to allow flexibility of the pad for separation of the pad at the split.

17 Claims, 8 Drawing Sheets

NECK COLLAR

FIELD OF THE INVENTION

This invention relates generally to protective gear for sports and, more specifically, to protective neck collars and braces for use by those wearing helmets.

BACKGROUND OF THE INVENTION

Protective gear for participants in various activities such as motorsports has been standard for years. Motocross riders, for example, are accustomed to wearing head-to-toe protective gear, including a helmet, a neck collar, a chest or roost protector, spine protection, hip and tailbone pads, knee braces or at least pads, and protective boots. This gear has resulted in a significant reduction in injuries to the wearers. However, while a helmet is usually the most cited or recognizable item of protective gear and while it protects the head of the user, it can worsen injuries to the neck due to its mass and rigid shell, particularly the lower rim. The mass of the helmet can cause extra force to pull the head back, to the side, or forward. Nevertheless, the helmet has been found to be worthwhile protective piece.

If used in conjunction with a neck collar, the helmet's protective benefits are further improved. Many riders use foam neck collars to absorb impact of the helmet against the body and limit excessive movement of the head so help avoid neck injury. However, the foam does not disperse energy well over a large portion of the body, such that the point of contact with the rigid lower edge of the helmet extends through the foam in a localized portion of the foam injuring the body and potentially still allowing excessive neck strain.

Furthermore, the fit of the neck collar may not be optimal for all users. If the collar has a back brace, it may not fit a wide range of wearers, depending on the thickness of the upper body (chest, shoulders, and upper back) of the wearer. An incorrect fitting neck collar may not effectively prevent injury. Or the person may completely omit wearing a collar that is not comfortable.

The inventor of the present invention has found that absorption and dispersion of energy in a collar that is comfortable and doesn't point load the body during impact is important in providing a protective neck collar. The collar must also limit excessive movement of the helmeted head, while allowing necessary freedom of movement for the chosen activity. The neck collars currently available do not seem to provide this combination of benefits.

SUMMARY OF THE INVENTION

The present invention provides a protective neck collar for use by a person wearing a helmet. The collar includes a pad and a shell. The shell and the pad combine with a back support to provide a neck collar that absorbs and disperses impact loads effectively. The collar also adjustably fits the user and is easy to put on and take off.

The pad forms at least a partial loop to surround the neck of the wearer beneath a lower edge of the helmet (such as a full-face helmet). The pad is formed of compressible material and includes an upper face and a lower face. The lower face is positioned for opposing and bearing against the person when worn. The pad is elastic within its normal range of use. A closed-cell foam material is preferably formed into the desired donut shape of the pad. The pad includes a rear shoulder shelf wider than the remainder of the donut shape. This wider region provides for increased energy absorption and increased impact area for the rear of the helmet, upon impact with the rear edge of the helmet.

The shell overlies at least a portion of the upper face of the pad. It is formed of a material more rigid than the pad and is situated for at least intermittent contact with the lower edge of the helmet upon use. The helmet impacts the shell, which disperses impact energy to a larger area of softer pad material and over a larger area of the body (shoulders, back, and chest) of the wearer.

In a preferred embodiment, the pad includes a front, chest portion that is split such that it forms a right side and a left side that are separable from each other for donning and doffing the collar. The shell also includes a front, chest portion overlying he pad chest portion. The shell chest portion is split with a right side and a left side that are separable from each other for donning and doffing the collar. The shell is plastic composite and is bonded to the pad over portions of the upper surface and sides of the pad. The shell includes a lateral shoulder portion having a gap. The gap opens a portion of the pad from being bonded to the shell along a small region of the pad. This gap allows the chest portion of the collar to move laterally upon flexure of a lateral region of the pad (i.e., at the gap) that is not overlayed with the shell. The shell includes a closure tab between the right and left sides of the chest portion.

In one embodiment, the neck collar includes a liner covering most of the lower face of the pad. In an alternate embodiment, the liner also extends upwardly along portions of the inner sides of the pad. The liner is constructed of a molded EVA foam material. The liner overlaps the split between the left and right sides of the pad chest portion. The liner has a fastener to secure the right and left sides of the pad chest portion together.

The neck collar further includes a back support brace secured beneath the lower face of the pad at a rear portion of the pad. The back support brace extends down a portion of the back of the shoulders of the person wearing the collar. A rear strut extends between a lower portion of the back support brace and the rear portion of the pad. The rear strut is preferably at least somewhat flexible. The strut absorbs energy upon impact of the collar with the edge of the helmet. In the preferred embodiment, the rear strut is adjustable to change the relative position of the back support brace and the chest portion of the pad.

In one aspect of the invention, the neck collar is secured to the wearer with a harness. The harness extends under the arms of the wearer with a clasp in the front. It is also adjustable.

As will be readily appreciated from the foregoing summary, the invention provides additional protection for the neck of a person wearing a helmet. The collar includes a pad providing a comfortable interface to the wearer with a shell over portions of the pad to deal with impact from the edge of the helmet and disperse the impact load. In this way the energy of impact is absorbed and user is more comfortably protected. The arrangement is substantially the reverse of the prior-art prophylactic neck collars, which include a somewhat rigid frame with padding on top of the frame opposite the bottom edge of the helmet.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
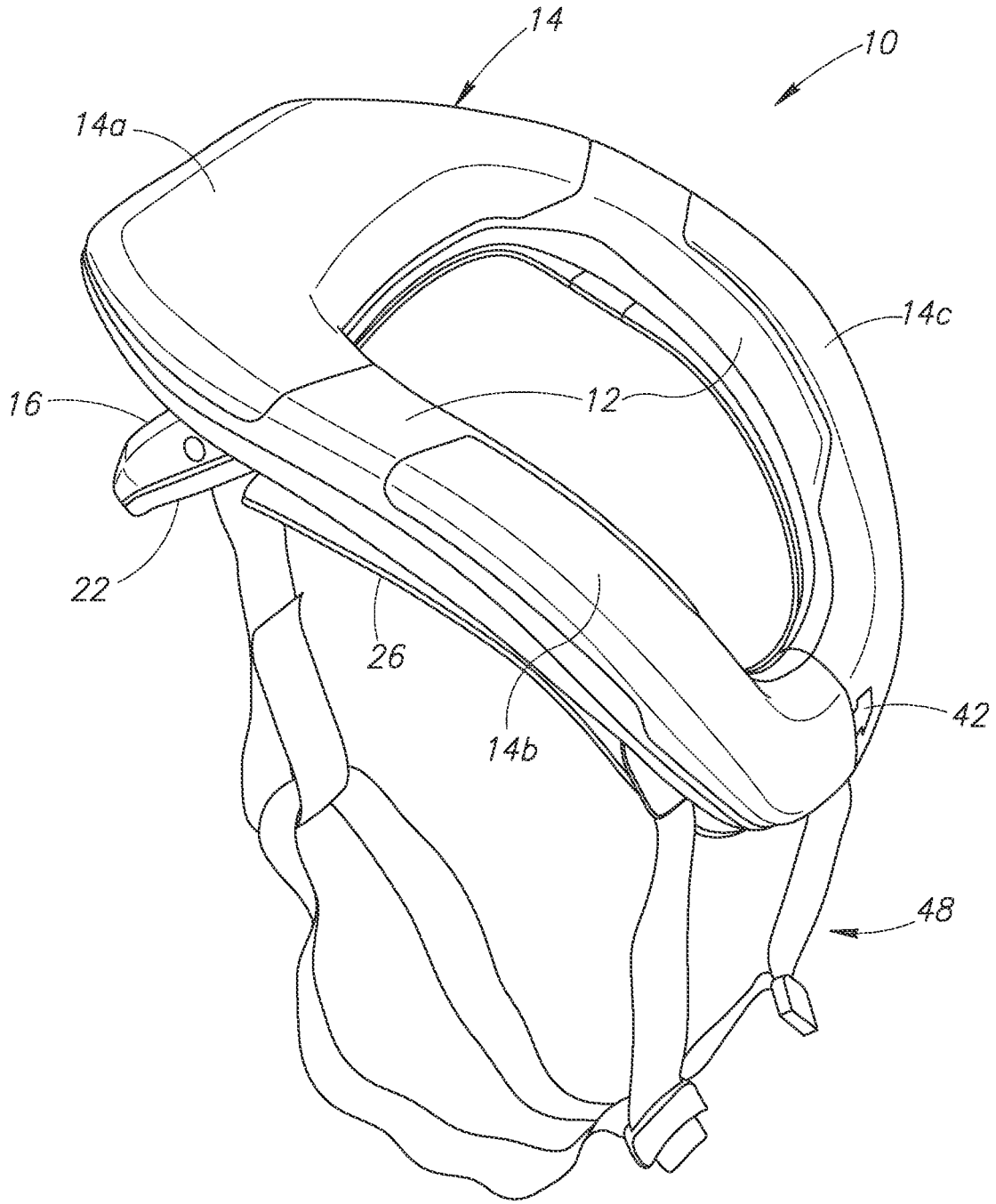
FIG. 1 is a perspective view of the neck collar of the present invention from the top left side.
Figure 2:
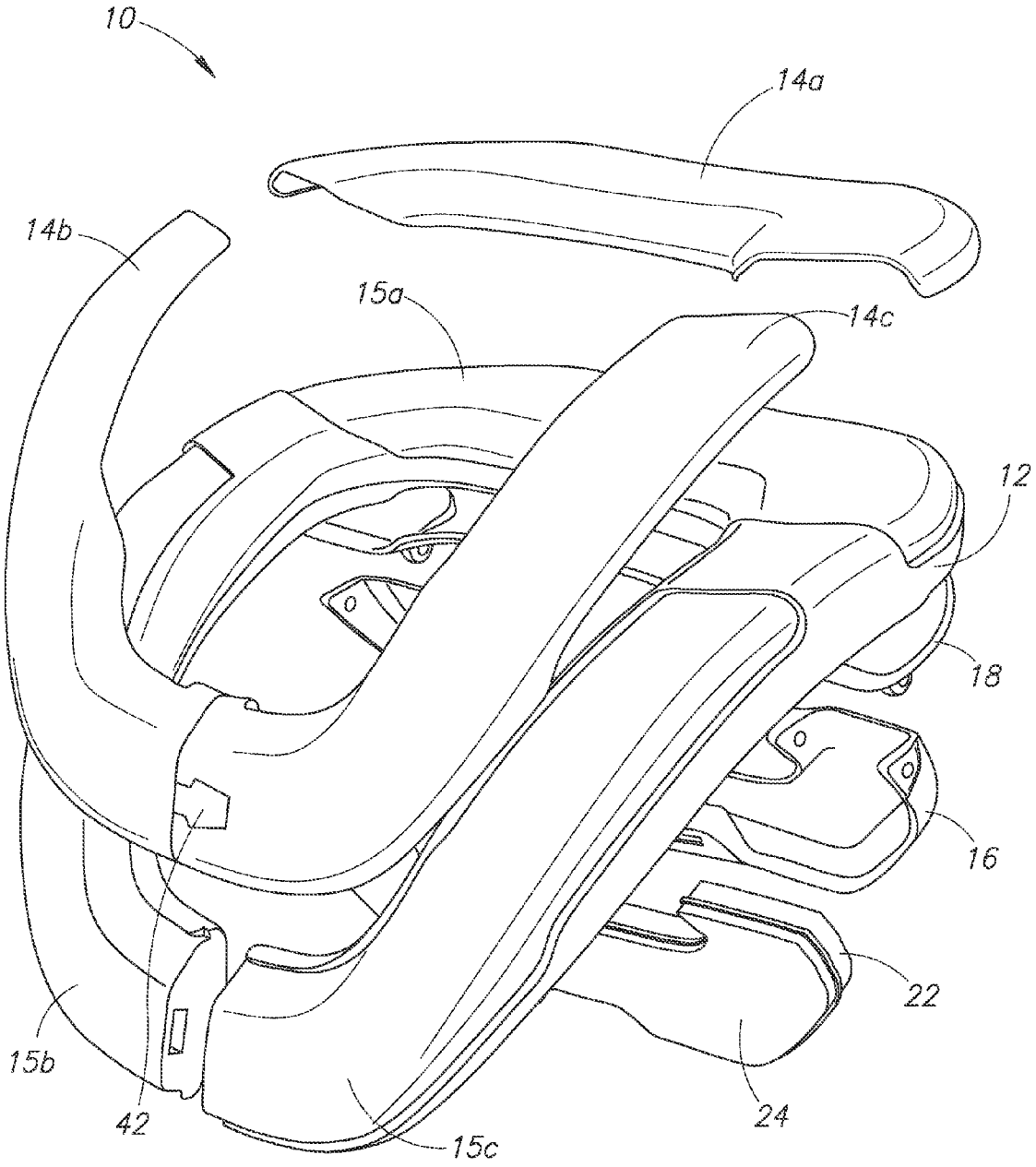
FIG. 2 is an exploded view of the neck collar of FIG. 1.

The present invention comprises a neck collar for use with a helmet to prevent neck injuries from impacts the user may encounter in activities ordinarily carried out with the use of a protective helmet. As shown in FIGS. 1 and 2, a neck collar 10 is provided to interface with the lower edge of a helmet to absorb the energy of impact and restrain excessive head movement and whip in an impact to the head or body of the wearer.

Neck collar 10 includes a pad 12 and a shell 14. Pad 12 forms a donut shape that surrounds the neck of the wearer above the shoulders, chest, and upper back. The pad is preferably made of a closed-cell foam material, such as polyurethane. Alternatively, the pad may be constructed of various materials that absorb the impact load as the edge of the helmet strikes the collar. The material also provides comfort to the wearer as the pad can contour to the user as it presses against the user. Elasticity in the pad material is preferable, such that the collar may be used for more than a single substantial impact.

Shell 14, in the preferred embodiment, selectively covers portions of the top of pad 12. Shell 14 is constructed of a more rigid material than pad 12, such that it disperses the impact load from the helmet over a broader region of pad 12 as the energy is absorbed. The softer pad material provides a cushion to conform and distribute the load against the user's shoulders, collar bone, chest, and/or back. In this manner, the energy of impact of the helmet is less likely to injuriously bear on the body of the user. Shell 14 is preferably constructed of plastic material vacuum formed into a shell shape to extend over the top and partially down the sides of pad 12. Shell 14 is preferably bonded with glue to pad 12. Shell 14 includes a rear shell portion 14*a*, a right shell portion 14*b*, and a left shell portion 14*c* extending over a rear recess 15*a*, a right recess 15*b*, and a left recess 15*c*, respectively, of pad 12. See FIG. 2.

The recesses 15*a-c* are slight, preferably about the same depth as the thickness of shell 14, such that the shell fits therein with a smooth exterior transition between pad 12 and shell 14. The wide rear region of pad 12 and shell 14 allows for good load dispersal as well as a broad impact base to ensure that the edge of the helmet is restrained.

Figure 3:
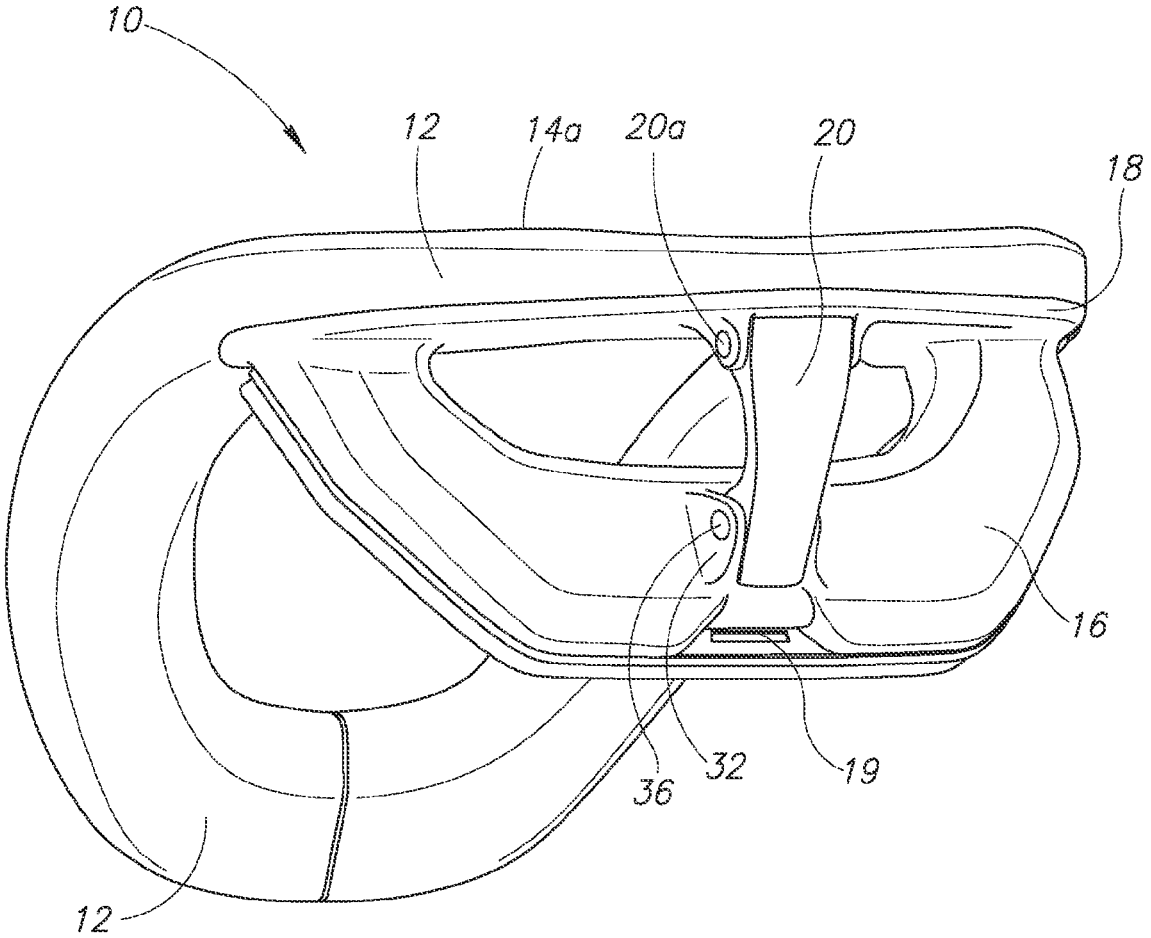
FIG. 3 is a perspective rear underside view of the neck collar from the left side.
Figure 4:
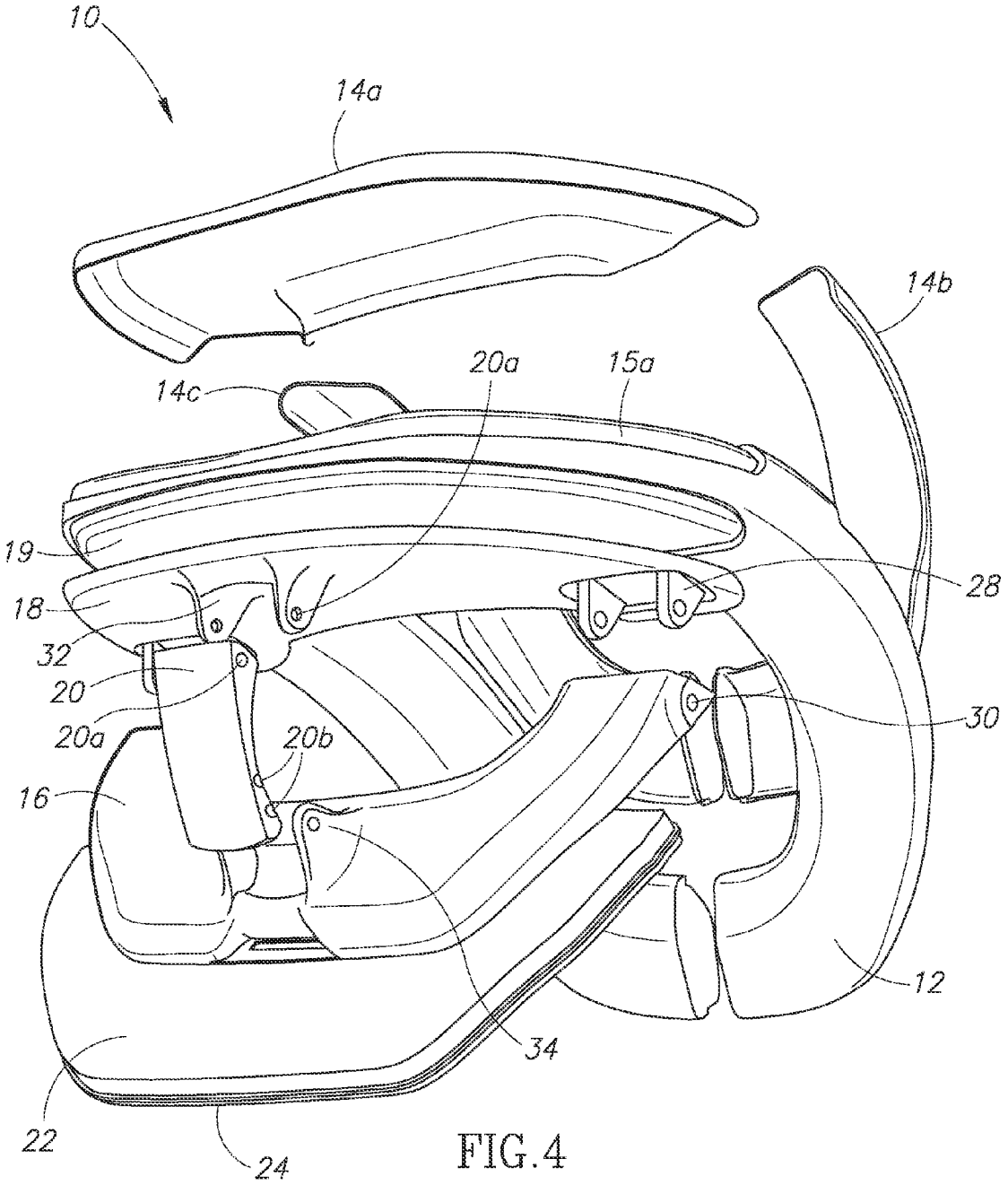
FIG. 4 is an exploded view of the neck collar of FIG. 3, from the right side.

FIGS. 3 and 4 illustrate back support 16. Back support 16 extends downwardly from the rear underside of pad 12 to contact the upper back and shoulder blade region of the wearer to support against the helmet impact on the rear portion of shell 14 and pad 12. An under-pad structural member 18 is preferably secured to the rear underside of pad 12 within a slight underside recess 19. Structural member 18 preferably extends substantially directly under rear shell portion 14*a*, with a rear portion of pad 12 sandwiched therebetween. Back support 16 is secured to a forward portion of structural member 18. Back support 16 is braced against folding up by a support strut 20 extending between a rear side of back support 16 and a rear portion of structural member 18.

Support strut 20 is preferably formed of a slightly flexible material to further absorb impact. However, the overall construction of pad 12 and back support 16 may have sufficient energy absorbing properties such that strut 20 may be less flexible and simply transmit loading from structural member 18 to back support 16. Strut 20, in some embodiments, also has a shape to provide some degree of flexibility, while still not folding completely so as to provide impact absorption without allowing excessive head movement and neck injury. Support strut 20 includes a pin hole 20*a* for a pin to secure the upper end of strut 20 to structural member 18. Strut 20 also includes adjustment holes 20*b* (see FIG. 4) at its lower end for adjustable attachment to back support 16. Various alternate methods and means of adjustable attachment may be employed. For example, a screw adjustment system may be employed. In other embodiments, multiple struts may be used between structural member 18 and back support 16.

Referring more particularly to FIG. 4, a back pad 22 is secured within back support 16. Back support 16 is constructed of a half shell having sides extending forwardly from the back shell portion to provide structural strength and rigidity to the overall support member. Back pad 22 nests within and projects slightly beyond the half shell to increase the comfort to the wearer and absorb energy of impact.

In an alternate embodiment, a back liner 24 is secured to back pad 22, preferably with a hook and loop fastener. Back liner 24 is constructed of an EVA foam material for additional comfort and absorption qualities. In the preferred embodiment, back liner 24 is integrated with back pad 22. A pad liner 26 is also provided along the underside of pad 12 for the same purposes. Pad liner will be discussed in more detail below in connection with FIG. 5.

Returning to the interconnection and support for the rear portion of pad 12 and shell 14, four pivot bosses 28 project downwardly from the underside of structural member 18. Two pivot bosses 28 extend from the right side of structural member 18 and two extend from the left side. The right and left pivot bosses 28 secure right and left sides of back support 16, respectively, with a pinned pivotal attachment. Strut bosses 32 extend downwardly from the rear center portion of structural member 18. Strut bosses 32 secure the upper end of support strut 20 with a pin. The lower end of support strut 20 is secured to back support bosses 34 with a removable pin or other fastener.

The preferred pivotal attachment allows back support 16 to be adjusted for the size of the chest and back of the user. Thus, a secure fit can be achieved to reduce undesirable shifting movement of neck collar 10 on the user. Adjustment is carried out in the preferred embodiment of the invention by removal of the pin or fastener securing the lower end of support strut 20 and securement of the fastener in the adjustment hole 20*b* that most closely and comfortably positions back support 16 against the upper back of the wearer. Once the preferred position of the back support member is obtained, the pin is placed in the closest adjustment hole 20*b* in the lower end of support strut 20.

While pad 12 is generally donut shaped, it preferably includes a split front to aid in donning and doffing neck collar 10. The facing split surfaces include coupler recesses to accommodate a coupler extending from shell 14. Left shell portion 14*c* includes a coupler tab 42 (see FIG. 2) projecting to the right from the end thereof that covers the split end of pad 12. Right shell portion 14*b* includes a coupler slot 44 to receive tab 42 and engage therewith. Tab 42 preferably provides a spring detent action to clip within coupler slot 44. Tab 42 is disengaged from slot 44 by pressing downwardly on the portion nested within left shell 14*c*.

Figure 5:
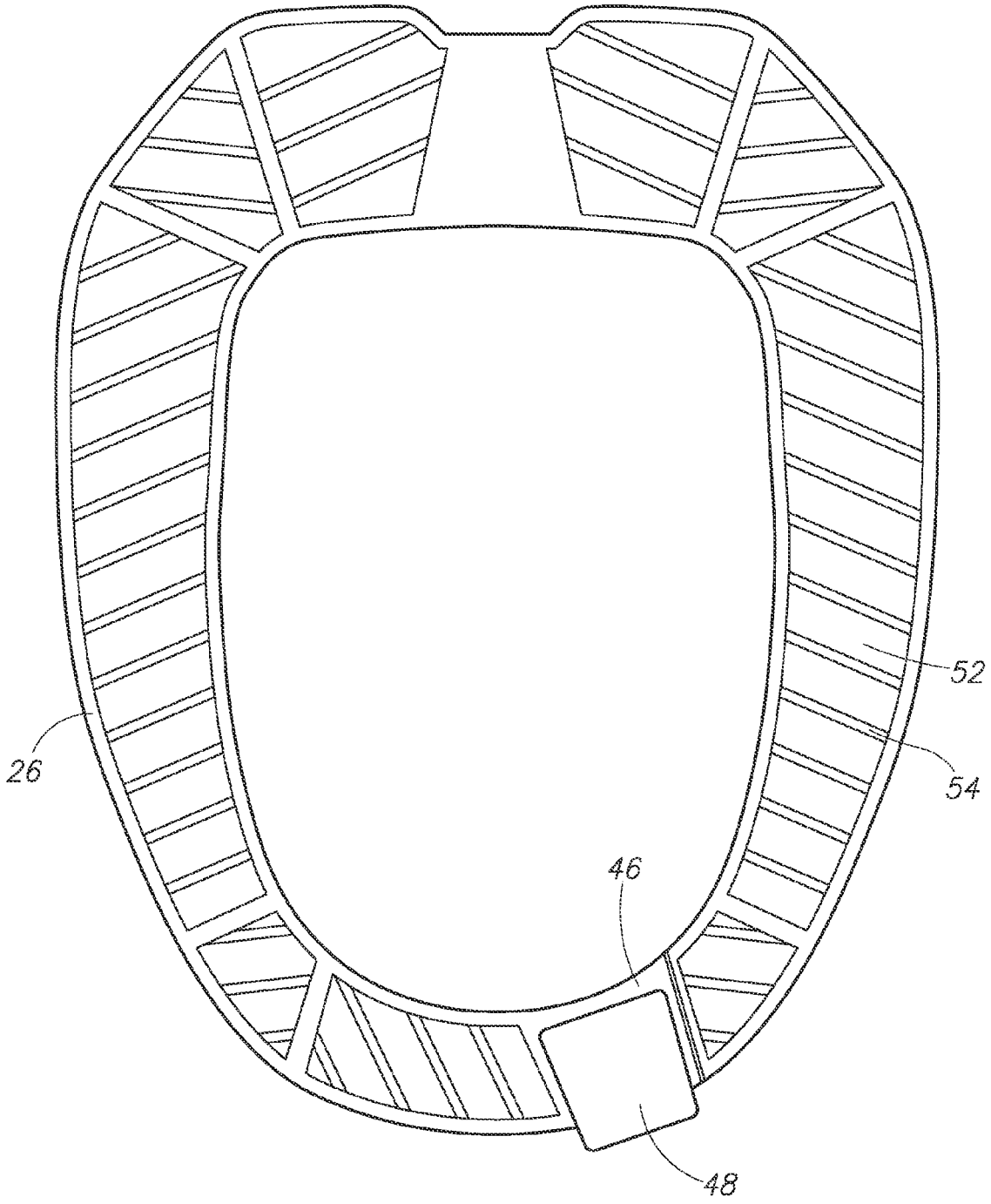
FIG. 5 is a plan view of a liner for the neck collar of FIGS. 1-4.

Securement of the split ends of pad 12 is also carried out by an overlapping portion 46 of pad liner 26, as seen in FIG. 5. Liner 26 forms a ring with overlapping portion 46 being joined to the opposite end of liner 26 with a hook-and-loop fastener 50. A release tab 42 is secured to the end of liner 26 that overlaps below the other end. This tab can be grasped by the wearer to remove the overlapping connection and open the collar by disengaging coupler tab 42 from coupler slot 44.

Hook-and-loop fastener 50 is also secured to the upper side of liner 26 and the lower side of pad 12 to engage them together. As seen in FIG. 5, the lower face of liner 26 includes ridges 52 and recesses 54. These ridges and recesses aid the comfort of the wearer and provide air circulation under liner 26. The contours are preferably formed in the EVA material of liner 26 when the liner is formed.

Figure 6:
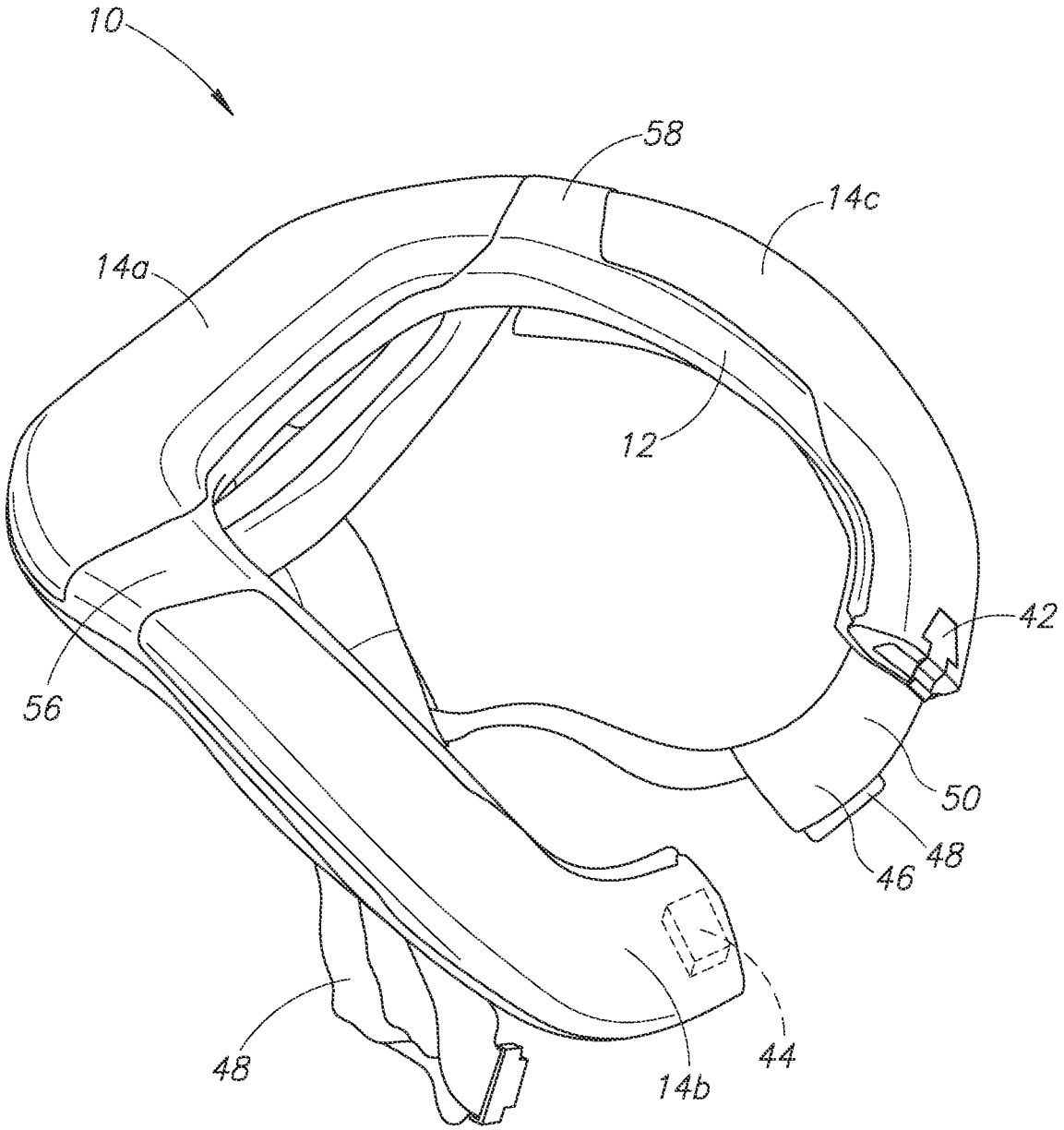
FIG. 6 is a perspective view of the collar with the sides flexed open.

FIG. 6 illustrates a flexed open position of neck collar 10. This is the position the collar is held in to don or doff the collar. The collar is flexed open, placed around the neck of the user, closed, secured with tab 42 and overlapping portion 46, after which a harness 48 is secured around the back and chest of the wearer below the neck collar and under the wearers arms, with a fastener in front, below the chest portion of pad 12. See also FIGS. 7 and 8. The space between right shell portion 14*b* and rear shell portion 14*a* provides a portion of pad 12 to which a shell material has not been bonded. This region provides a right flex zone 56. A left flex zone 58 is likewise provided. In alternate embodiments, shell 14 may cover all zones, but may be non-bonded to pad 12 in overlap regions such that pad 12 can flex beneath shell 14 to facilitate the flexure opening of the split ends of pad 12. Further additional flex zones may alternatively be provided, as long as the shell covers sufficient area on top of the pad to disperse the impact load from the helmet. Note that the lower edge of the helmet will bridge flex zones 56, 58 to transfer load across the flex zones and onto the shell portions.

Figure 7:
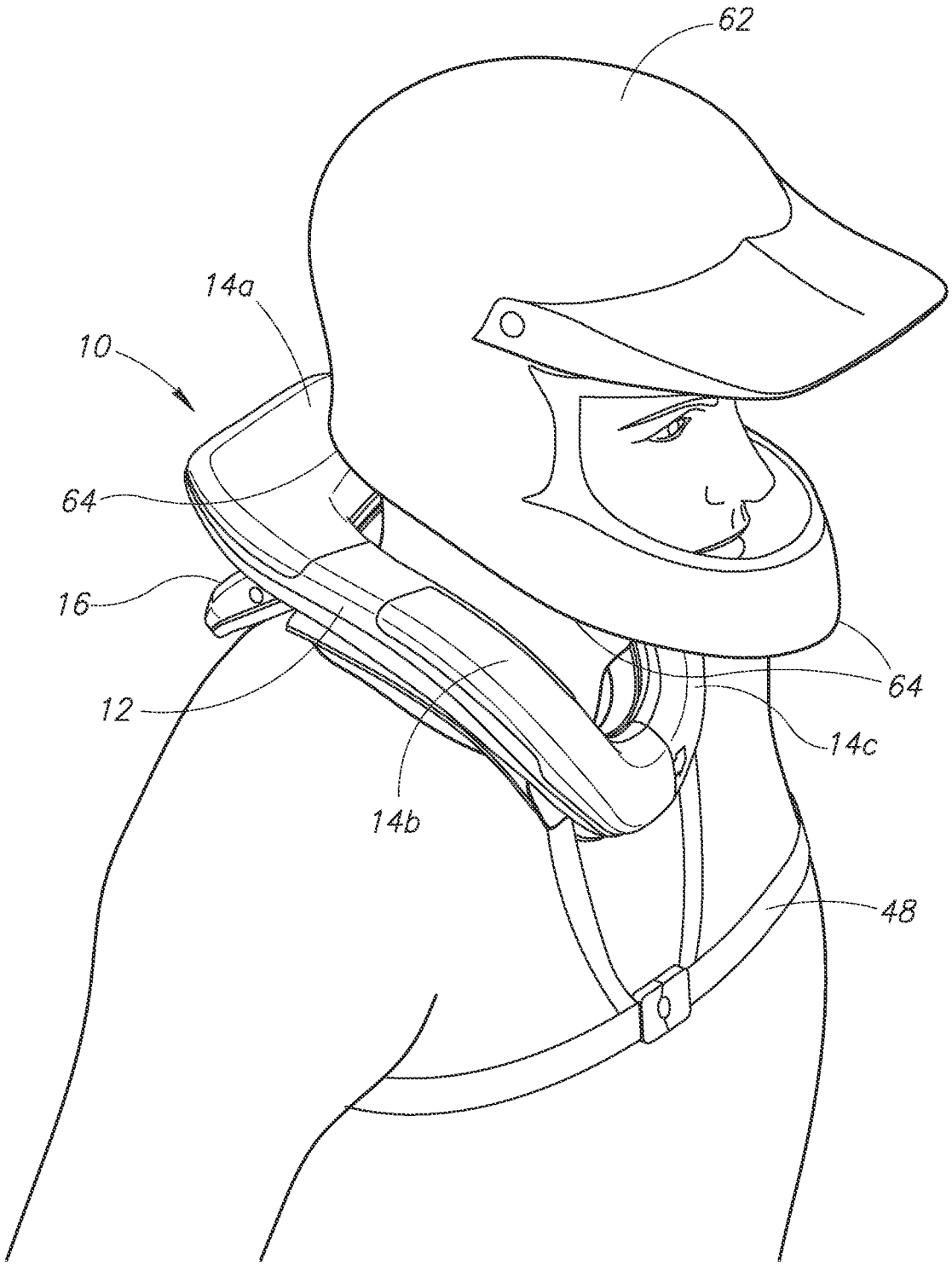
FIG. 7 is a perspective view of the neck collar and harness on a person.
Figure 8:
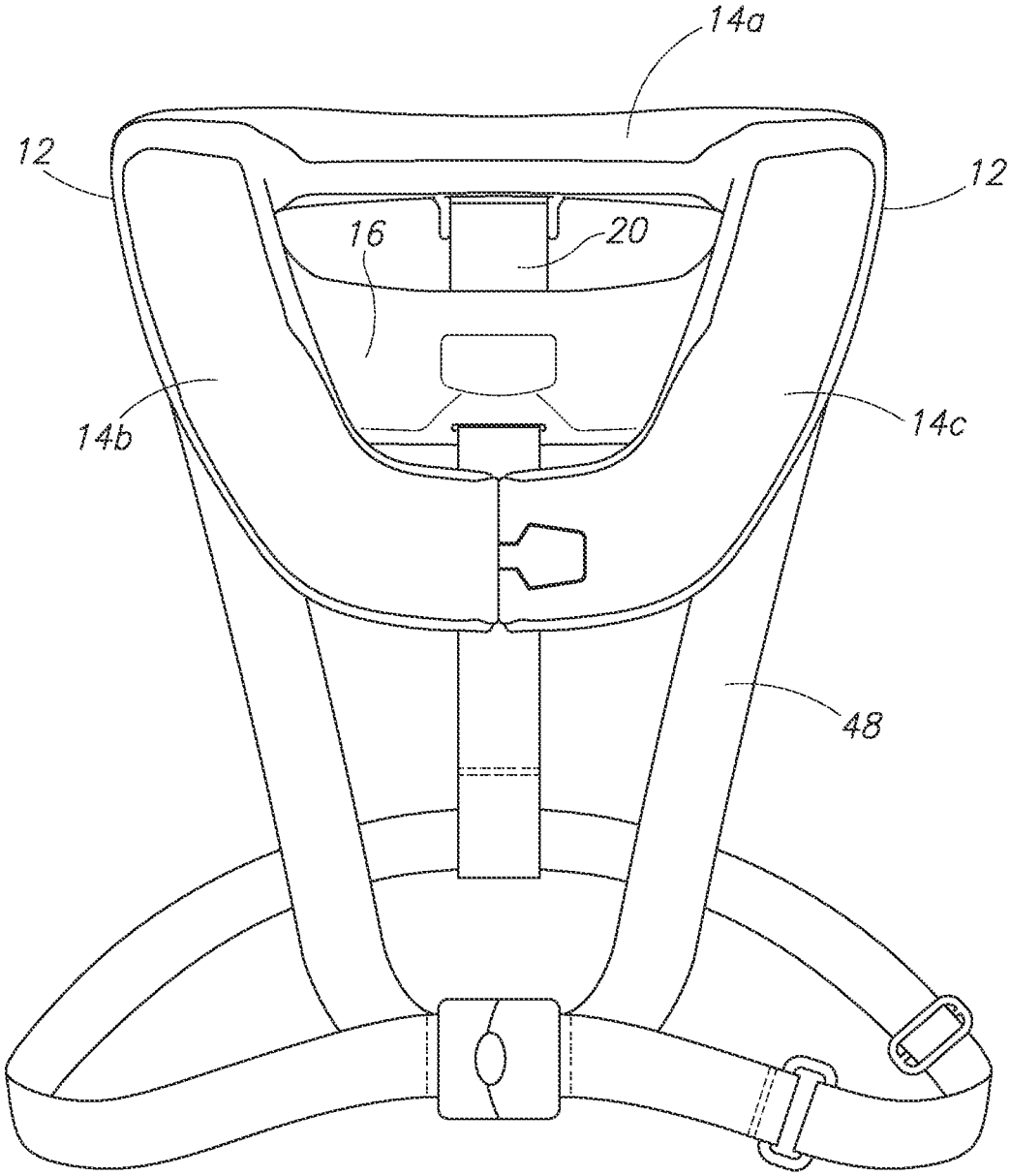
FIG. 8 is a front elevational view of the neck collar, including the harness.

FIG. 7 illustrates a user wearing a helmet 62 having neck collar 10 secured in place. Note the positioning of lower edges 64 of helmet 62 adjacent and above the upper faces of shell 14. Upon an impact situation, such as a motorcycle crash, the head and helmet 62 may be thrust forwards, backwards, and/or sideways. It will then contact shell 14 of neck collar 10, restraining the head from excessive movement such that neck injury is reduced or avoided. Shell 14 is sufficiently rigid and robust to spread the impact load over a larger area of pad 12 such that it both absorbs energy and spreads the impact load to a larger area of the body of the wearer. Thus, a dangerous concentrated impact on the body is avoided.

A neck collar for use by a person wearing a helmet having a lower edge may comprise: (a) a pad forming at least a partial loop, the pad being of compressible material, the pad having an upper face and a lower face, the lower face positioned for opposing the person when worn around a neck of the person; and (b) a shell overlying at least a portion of the upper face of the pad, the shell being formed of a material more rigid than the pad and being situated for at least intermittent contact with a lower edge of the helmet upon use; (c) wherein the pad includes a front, chest portion that is split with a right side and a left side that are separable from each other for donning and doffing the neck collar; (d) wherein the shell includes a shell rear portion and a shell chest portion overlying a pad chest portion, the shell chest portion being split with a right side and a left side that are separable from each other for donning and doffing the neck collar; (e) wherein the right side and left side of the chest portion are separate members from the shell rear portion and gaps are defined between the shell rear portion and the right and left sides of the shell chest portion such that the shell does not cover any portion of the pad along small regions of the pad extending between the right and left sides of the shell chest portion and the shell rear portion, thus allowing the shell chest portion to move laterally upon flexure of the small regions of the pad that are not covered with the shell. The shell chest portion and shell rear portion are separate pieces thus allowing a chest portion of the neck collar to move laterally upon flexure of a small region of the pad between the rear shell portion and chest shell portion.

A neck collar for use by a person wearing a helmet having a lower edge, the neck collar may comprise: (a) a pad forming at least a partial loop, the pad being of compressible material, the pad having an upper face and a lower face, the lower face positioned for opposing the person when worn around a neck of the person; and (b) a shell overlying at least a portion of the upper face of the pad, the shell being formed of a material more rigid than the pad and being situated for at least intermittent contact with a lower edge of the helmet upon use; (c) wherein the shell includes a rear shell portion and a chest shell portion, the rear shell portion being a separate member from the chest shell portions and a first gap being defined between a left side of the chest shell portion and the rear shell portion and a second gap being defined between the right side of the chest shell portion and the rear shell portion such that the shell does not cover portions of the pad spanning the first and second gaps from the chest shell portion to the rear shell portion, the first and second gaps being positioned over shoulder portions of the pad, thus allowing the chest shell portion of the neck collar to move laterally upon flexure of the portions of the pad spanning the first and second gaps from the chest shell portion to the rear shell portion, the first and second gaps being positioned over shoulder portions of the pad.

While the preferred embodiments of the invention has been illustrated and described, as noted above, many changes can be made without departing from the spirit and scope of the invention. For example, a fixed rather than pivotal connection of the back support to the pad and shell may be employed. The liner may extend up within the sides of the pad rather than simply along the bottom surface of the pad. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A neck collar for use by a person wearing a helmet having a lower edge, the neck collar comprising:

a pad forming at least a partial loop, the pad being of compressible material, the pad having an upper face and a lower face, the lower face positioned for opposing the person when worn around a neck of the person; and a shell overlying at least a portion of the upper face of the pad, the shell being formed of a material more rigid than the pad and being situated for at least intermittent contact with a lower edge of the helmet upon use, the shell including a rear portion and first and second chest portions;

wherein the shell defines a first gap between the rear portion and the first chest portion and adapted to be positioned over a first lateral shoulder region of the person such that the shell does not cover a first portion of the pad along a first small region of the pad, thus allowing the first chest portion of the neck collar to move laterally upon flexure of the small region of the pad that is not overlaid with the shell;

wherein the shell defines a second gap between the rear portion and the second chest portion and adapted to be positioned over a second lateral shoulder region of the person such that the shell does not cover a second portion of the pad along a second small region of the pad, thus allowing the second chest portion of the neck collar to move laterally upon flexure of the second small region of the pad that is not overlaid with the shell;

wherein no portion of the shell spans the first gap to connect the first chest portion to the rear portion and no portion of the shell spans the second gap to connect the second chest portion to the rear portion.

2. The neck collar of claim 1, wherein the chest shell portion is split between a right side and a left side such that the right side and left side are separable from each other for donning and doffing the neck collar.

3. The neck collar of claim 2, wherein the right side and left side are separable from each other for donning and doffing the neck collar.

4. The neck collar of claim 3, wherein the shell includes a closure tab between the right side and the left side of the chest portion of the shell.

5. The neck collar of claim 3, further comprising a liner disposed along the lower face of the pad and overlapping split between the left and right sides of the pad chest portion, the liner having a fastener to secure the right and left sides of the pad chest portion together.

6. The neck collar of claim 1, further including a back support brace secured beneath the lower face of the pad at a rear portion of the pad, the back support brace adapted to extend down a portion of a back of shoulders of the person wearing the neck collar.

7. The neck collar of claim 6, further comprising a rear strut between a lower portion of the back support brace and the rear portion of the pad, the rear strut being flexible and energy absorbing upon impact of the neck collar with an edge of the helmet.

8. The neck collar of claim 7, wherein the rear strut is adjustable to change a relative position of the back support brace to a chest portion of the pad.

9. The neck collar of claim 6, further comprising a harness for holding the pad to the person, the harness having a strap adapted to extend under at least one arm of the person.

10. The neck collar of claim 1, wherein the compressible material is elastic within its normal range of use.

11. The neck collar of claim 10, wherein the compressible material is a closed-cell foam.

12. The neck collar of claim 1, further comprising a liner disposed about most of the lower face of the pad and within inner sides of the pad.

13. The neck collar of claim 12, wherein the liner comprises a molded EVA foam material.

14. The neck collar of claim 1, wherein the pad includes a rear shoulder portion wider than a remainder of the pad for increased energy absorption upon impact with an edge of the helmet.

15. The neck collar of claim 1, wherein the shell is plastic and is bonded to the pad over portions of an upper surface of the pad and over portions of sides of the pad.

16. A neck collar for use by a person wearing a helmet having a lower edge, the neck collar comprising:

a pad forming at least a partial loop, the pad being of compressible material, the pad having an upper face and a lower face, the lower face positioned for opposing the person when worn around a neck of the person; and a shell overlying at least a portion of the upper face of the pad, the shell being formed of a material more rigid than the pad and being situated for at least intermittent contact with a lower edge of the helmet upon use;

wherein the pad includes a front, chest portion that is split with a right side and a left side that are separable from each other for donning and doffing the neck collar;

wherein the shell includes a shell rear portion and a shell chest portion overlying a pad chest portion, the shell chest portion being split with a right side and a left side that are separable from each other for donning and doffing the neck collar;

wherein the right side and left side of the chest portion are separate members from the shell rear portion and two gaps are defined between the shell rear portion and the right and left sides of the shell chest portion, respectively, such that the two gaps are adapted to be positioned over respective first and second lateral shoulder regions of the person and the shell does not cover any portion of the pad along small regions of the pad extending between the right and left sides of the shell chest portion and the shell rear portion and such that no portion of the shell connects the right and left sides of the shell chest portion to the shell rear portion, thus allowing the shell chest portion to move laterally upon flexure of the small regions of the pad that are not covered with the shell.

17. A neck collar for use by a person wearing a helmet having a lower edge, the neck collar comprising:

a pad forming at least a partial loop, the pad being of compressible material, the pad having an upper face and a lower face, the lower face positioned for opposing the person when worn around a neck of the person; and a shell overlying at least a portion of the upper face of the pad, the shell being formed of a material more rigid than the pad and being situated for at least intermittent contact with a lower edge of the helmet upon use;

wherein the shell includes a rear shell portion and a chest shell portion, the rear shell portion being a separate member from the chest shell portions and a first gap being defined between a left side of the chest shell portion and the rear shell portion and a second gap being defined between the right side of the chest shell portion and the rear shell portion such that the shell does not cover portions of the pad spanning the first and second gaps from the chest shell portion to the rear shell portion, the first and second gaps are adapted to be positioned over first and second lateral shoulder regions of the person, thus allowing the chest shell portion of the neck collar to move laterally upon flexure of the portions of the pad spanning the first and second gaps from the chest shell portion to the rear shell portion.

* * * * *